United States Patent [19]

Howard

[11] Patent Number: 4,460,080

[45] Date of Patent: Jul. 17, 1984

[54] COIN VALIDATION APPARATUS

[75] Inventor: George R. Howard, Wimborne, England

[73] Assignee: Aeronautical & General Instruments Limited, Croydon, England

[21] Appl. No.: 354,694

[22] Filed: Mar. 4, 1982

[30] Foreign Application Priority Data

Mar. 19, 1981 [GB] United Kingdom ..... 8108625

[51] Int. Cl.[3] ..... G07D 5/08

[52] U.S. Cl. ..... 194/100 A; 324/236

[58] Field of Search ..... 194/97 R, 100 A, 100 R, 194/99; 73/163; 324/236, 237, 327; 331/65, 181, 177 R

[56] References Cited

U.S. PATENT DOCUMENTS

| | | | |
|---|---|---|---|
| 3,401,780 | 9/1968 | Jullien-Davin | 194/100 R |
| 3,870,137 | 3/1975 | Fougere | 194/100 A |
| 3,918,564 | 11/1975 | Heiman et al. | 194/100 A |
| 4,234,071 | 11/1980 | Le Hong | 194/100 A |
| 4,349,095 | 9/1982 | Lewis | 194/100 A |
| 4,387,338 | 6/1983 | Hecht et al. | 194/100 A |

*Primary Examiner*—F. J. Bartuska

*Attorney, Agent, or Firm*—Sughrue, Mion, Zinn, Macpeak and Seas

[57] ABSTRACT

Coin validation apparatus may be associated with a coin freed mechanism on coin receiving machines or form part of a coin sorting apparatus to check that coins are valid coins and not counterfeit. Recently, it has become particularly convenient to use the interaction between a coin and an alternating magnetic field to gauge various parameters of the coin thereby to determine if the coin is valid. In such a method the frequency of a feedback oscillator having a tuned electrical coil in its feedback loop is monitored when a coin is present adjacent the coil, the frequency is then monitored when a phase shift or time delay network is also included in its feedback loop, two parameter signals characteristic of the effect of the coin on both the inductance and the loss factor of the coil, are derived from these maintained frequencies and the two parameter signals are compared with reference values to determine if the coin is valid.

13 Claims, 9 Drawing Figures

COIN VALIDATION APPARATUS

Coin validation apparatus may be associated with a coin freed mechanism on a variety of coin receiving machines such as coin box telephones or vending machines or form part of a coin sorting apparatus to check that coins are valid coins and not counterfeit. There are many different types of coin validation apparatus in use, but recently, with the introduction of modern electronic devices to control the operation of coin receiving machines and sorting apparatus, it has become particularly convenient to use the interaction between a coin and an alternating magnetic field to gauge various parameters of the coin to thereby determine if the coin is valid.

There have been a wide variety of different proposals for such coin validation apparatus but, at least at present, many of the techniques which rely solely on the interaction between the coin and an alternating magnetic field have not proved to be successful on a commercial scale.

According to this invention a method of validating a coin comprises monitoring the frequency of a feedback oscillator having a tuned electrical coil in its feedback loop, when a coin is present, adjacent the coil, monitoring the frequency of the feedback oscillator when a phase shift or time delay network is also included in its feedback loop, deriving from the monitored frequencies two parameter signals characteristic of the effect of the coin on both the inductance and the loss factor of the coil, and comparing the two parameter signals with reference values to determine if the coin is valid.

The oscillation frequency of a tuned circuit feedback oscillator is dependent upon the inductance and loss factor of components within its feedback loop. The presence of a coin adjacent an electrical coil affects the inductance and loss factor of that electrical coil. Thus, by monitoring the resonant frequency of a feedback oscillator, information is derived with regard to the inductance and loss factor of components within its feedback loop which to some extent, depends upon the nature of the coin. With the method in accordance with this invention a phase shift or time delay network is selectively connected into the feedback loop of the feedback oscillator to introduce a particular known change in the characteristics of the feedback loop which results in a change in the frequency of the feedback oscillator, making it differ by an amount depending upon the coil loss resistance. Thus the resonant frequency of the oscillator when the phase shift is not connected in the feedback loop is representative of the inductance of the coil and the change in frequency which occurs when the phase shift or time delay network is included in the feedback loop is representative of the loss factor of the coil. The presence of a coin adjacent the coil has an influence on both the inductance and loss factor of the coil and consequently the monitored frequencies of the oscillator given an indication of the properties and characteristics of the coin.

According to another aspect of this invention a coin validation apparatus comprises an electrical coil, means to hold the coin at a fixed reference position adjacent the electrical coil, a feedback oscillator having the electrical coil in its feedback loop and also having a phase shift or time delay network switchable into and out of its feedback loop, frequency monitoring means for monitoring the frequency of the feedback oscillator and for producing an output signal indicative of its frequency, means responsive to the output signal of the frequency monitoring means both when the phase shift or time delay network is switched into and out of the feedback loop for producing two parameter signals characteristic of the effect of the coin on both the inductance and loss factor of the coil, and means to compare the two parameter signals with reference values to determine if the coil is valid and to output a coin validation signal when both parameter signals correspond to the reference values.

The frequency monitoring means, the means responsive to the output signal of the frequency monitoring means for producing the two parameter signals and the means to compare the two parameter signals with reference values may comprise a programmed microprocessor which is programmed to compare the output signal produced when the phase shift or time delay network is switched into the feedback loop of the feedback oscillator with the output signal produced when the phase shift or time delay network is switched out of the feedback loop to produce a first parameter signal and to produce a second parameter signal dependent upon the output signal produced when the phase shift or time delay network is switched out of the feedback loop. The second parameter signal may be the output signal produced when the phase shift of the delay network is switched out of the feedback loop or this output signal may be operated on by a fixed operator such as a constant division or subtraction.

Alternatively, the means responsive to the output signal of the frequency monitoring means for producing the two parameter signals may comprise first storage means for storing the output signal produced when the time delay or phase shift network is switched out of the feedback loop, first comparison means for comparing the output signals produced when the phase shift or time delay network is switched into the feedback loop with that produced when the phase shift or time delay network is switched out of the feedback loop to produce a first parameter signal, second storage means for storing at least two reference values, and second comparison means to compare the first parameter signal and the content of the first storage means which forms the second parameter signal, with the reference values stored in the second storage means to produce a coin validation signal when both coin parameter signals correspond to the stored reference values.

In this case, this means may be implemented either by a dedicated microprocessor arranged to perform this particular sequence of operations or by a hard wired logic circuit.

When a phase shift network is included it may be arranged to produce a constant fixed phase shift irrespective of the resonant frequency of the oscillator and this fixed phase shift is preferably a phase shift of about 45°. When a time delay network is included it may be arranged to introduce a fixed time delay and in this case the resulting phase shift that is introduced by the time delay network varies with the resonant frequency of the oscillation. However, it is also possible to use a phase shift or time delay network that does not have a constant characteristic, but, instead, results in a phase shift that varies with the resonant frequency of the oscillation. This variation in the phase shift with the resonant frequency of the oscillation does not affect the reliability of the validation.

The frequency of the oscillation depends to some extent upon the nature of the coin, and the frequency change brought about by the particular phase shift introduced by the phase shift or time delay network thus also depends to some extent upon the nature of the coin. Thus, even if the phase shift varies, the values of the two parameter signals are repeatable for coins of a particular denomination.

Preferably the phase shift network includes an operational amplifier having a parallel connected capacitive and resistive feedback network and an input resistor connected between the inverting input of the operational amplifier and ground. This integrating network provides a phase shift that varies to a small extent with the frequency of oscillation of the oscillator.

Preferably a solid state switch is provided in parallel with the resistive capacitive feedback network of the operational amplifier to short out the parallel capacitive and resistive feedback network of the operational amplifier when the phase shift network is to be switched out of the feedback loop of the feedback oscillator. This solid state switch is preferably formed by a transistor.

Preferably the coil is formed in two parts connected in series. In this case the fixed reference position of the coin with respect to the coils is with the coin located in between the two parts of the coil, and located against a stop. This ensures that the lines of force of the magnetic field induced by the coil are substantially normal to the face of the coin and this enables reliable and consistent measurements to be taken of the influence of the coin on the coil.

When the apparatus includes a microprocessor, the switching of the phase shift network into and out of the feedback loop of the feedback oscillator is preferably controlled by signals taken from the microprocessor. Alternatively, the phase shift network may be switched into and out of the feedback network under the control of a free running multi-vibrator.

The frequency monitoring means preferably includes a counter arranged to count the number of the oscillations of the feedback oscillator that occur within a preset time interval. The preset time interval may correspond to the time interval during which the phase shift network is connected into the feedback loop of the oscillator.

Two particular examples of the method and apparatus in accordance with the invention for providing the coin freed mechanism to be associated with a telephone will now be described with reference to the accompanying drawings; in which.

Figure 1A:
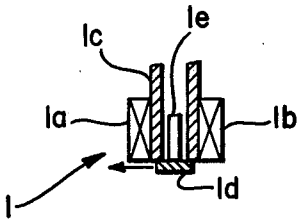
FIG. 1A is a sectional view showing the preferred manner of holding the coin in a reference position.

These examples of coin validation apparatus are intended to be used with a pay telephone using current British currency. The coin validation apparatus also includes the coin runway (FIG. 1A) described in our Published European Patent Application No. 0 040 019 which is incorporated herein by reference. It is the arrangement of this pivoting runway which determines the fixed reference position of the coin 1*e* against the stop 1*d* with reference to an electrical coil 1. The coil 1 is formed in two halves 1*a* and 1*b* connected in series with one half on one side of the coin runway 1*c* and the other half on the other side of the runway. The coil 1 together with a pair of ceramic capacitors 2 and 3 connected in parallel form a resonant tank circuit connected to the collector of one of a long tailed pair formed by transistors TR2 and TR3. The capacitors 2 and 3 are NPO type ceramic capacitors which have a very small temperature coefficient of not greater than 30 ppm/°C. and thus the temperature stability of the resonant tank circuit is high. The long tailed pair formed by transistors TR2 and TR3 together with the tank circuit comprise a feedback oscillator, having a feedback loop joining the collector of transistor TR3 to the base of transistor TR2. The feedback loop includes a phase shift network including a DC blocking capacitor 4, an operational amplifier 5 which is a model No. ICL 7611 manufactured by INTERSIL and which has a resistance 6 and a capacitance 7 connected in parallel in a feedback loop across the operational amplifier 5. A resistor 8 is connected between the inverting input of the operational amplifier 4 and a.c. ground. A transistor TR4 acting as a switch is also connected in parallel with the resistance 6 and capacitance 7 across the feedback path of the operational amplifier 5. When the transistor TR4 is conducting, the resistance 6 and capacitance 7 are switched out of the feedback path of the operational amplifier 5 since a direct connection is established, short circuiting the capacitance 7 and the resistor 6. The oscillating output from the feedback oscillator is taken from the collector of transistor TR2 via a buffer transistor TR1.

Figure 2:
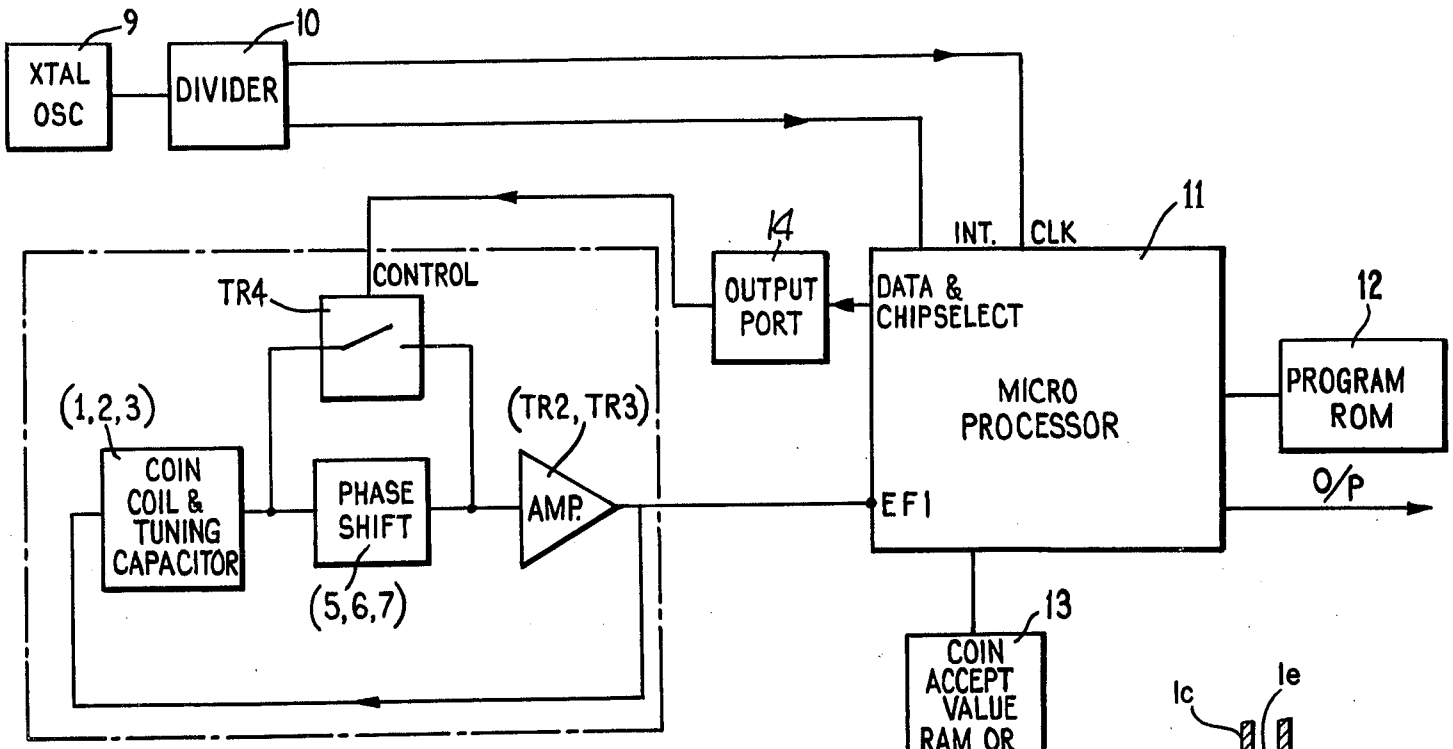
FIG. 2 is a block diagram of the first example.
Figure 1:
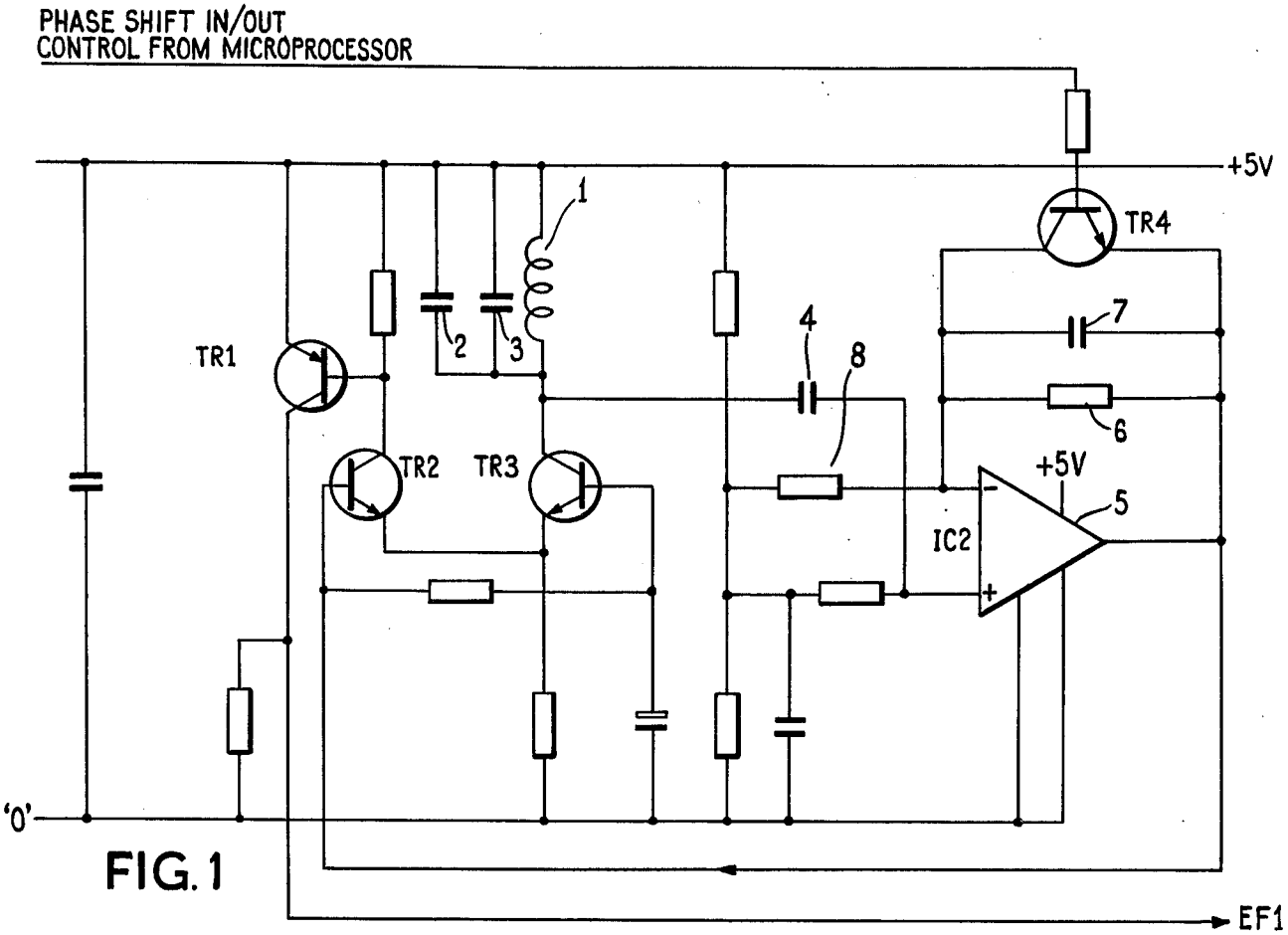
FIG. 1 is a circuit diagram of a feedback oscillator and phase shift network for use with both examples.

The part shown in FIG. 1 corresponds to the blocks contained in the chain dotted box shown in FIG. 2. The apparatus also includes a crystal oscillator 9 having its output fed to a divider unit 10, a microprocessor 11 and memories 12 and 13. Memory 12 is a read only memory which stores the program which controls the operation of the microprocessor 11. Memory 13 is a memory storing the reference values for coins that are acceptable and this may be a random access memory or a programmable read only memory. The crystal oscillator 9 together with the divider 10 provides the clocking and timing signals for the entire apparatus. The microprocessor controls via an output port 14 the transistor TR4 which switches the phase shift network into and out of the feedback loop of the oscillator.

The microprocessor 11 includes a counter and various other internal memories. Typically the microprocessor 11 is formed by model No. CCP 1802E manufactured by RCA. There are further inputs into the microprocessor 11 which are not shown in FIG. 2 but which come from the "on hook" contacts of the telephone and so provide an indication when the handset of the telephone is lifted and an input from a simple coin detector circuit including for example a simple light emitting diode and photodetector located adjacent the coin runway, the coin detecting circuit providing an indication when a coin is introduced into the coin freed mechanism.

When the handset is in place on the receiver of the telephone the apparatus is isolated from the power supply and has a zero power consumption. However, the voltage appearing across the telephone line is used to charge up a battery forming part of the apparatus to provide a power supply for the circuits when they are in operation. As the handset of the telephone is lifted from its cradle the "on hook" contacts of the telephone are arranged to connect the power supply to the circuits forming the coin validation apparatus. As the microprocessor 11 is being powered up, the first operation that takes place is the initiation of a 200 millisecond delay to allow the entire circuits to power up correctly.

As a coin is fed into the coin slot of the coin runway an output signal is obtained from the coin detector and fed to the microprocessor 11. This initiates a delay of $\frac{1}{3}$ of a second to allow sufficient time for the coin to come to rest in its fixed stable position against a stop formed by part of the coin runway so that the coin is in a fixed position between the two halves of the coil 1. Upon expiry of this $\frac{1}{3}$ of a second delay the microprocessor 11 then starts its validation function and the oscillator starts with the transistor TR4 conducting and the phase shift network formed by the capacitor 6 and resistor 7 switched out of the feedback loop of the oscillator. The counter in the microprocessor counts the number of changes in polarity from plus to minus that occur within a 3.75 millisecond period and stores the result in an internal memory of the microprocessor. The transistor TR4 is then switched off and the number of changes in polarity of the output of the oscillator from plus to minus that occur in a 3.75 millisecond period is again counted and, at the end of this 3.75 millisecond period the count is stored in another memory of the microprocessor 11. These two processes may be repeated for, for example, five to fifteen times with the results stored in a running total store to refine the measurement of the frequencies of the oscillator. The outputs from any such running total stores may be divided before being handled so that the number handling capacity of the microprocessor 11 is not exceeded. The difference between these two counts is derived and stored in a further internal memory.

The information stored in this further internal memory represents the difference between the frequency of the oscillator with the phase shift network switched into and out of the feedback loop when a coin is present in the coil 1. This difference in frequency gives an indication of the characteristics or nature of the coin in so far as it affects the loss resistance of the coil 1. The difference frequency provides the first parameter signal. The count stored in the memory and corresponding to that recorded when the coin is present in the coil 1 and the phase shift network is switched out of the feedback loop of the oscillator represents the second parameter signal that gives an indication of the characteristics or nature of the coin in so far as it affects the inductance of the coil 1. The number of changes in polarity that occur within the period of 3.75 milliseconds may be subjected to a constant mathematical operation such as a division or a subtraction to convert it into the second parameter signal. This is especially useful if the number of changes in polarity is high and so would, for example, exceed the number handling capacity of the microprocessor 11 or would necessitate a more powerful microprocessor.

The first and second parameter signals are both then compared with various acceptable values programmed into the memory 13 and if the two signals are characteristic of a valid coin an output signal is given from the microprocessor 11 firstly indicating that the coin is a valid coin and secondly indicating the denomination of that valid coin. Typically the memory 13 has a number of stored values and each of the values characteristic of the coin is compared with the stored values to make sure that each value is both greater than one of the stored values and less than the next of the stored values to provide an acceptance window to allow for a slight spread in the properties of the characteristics of coins that are acceptable. Typically, the memory 13 is loaded with the values of acceptable *2p*, *5p*, *10p* and *50p* coins.

The acceptance or rejection signal is used to control the coin runway to release the coin from its position against the stop to accommodate the coin in an acceptance channel for subsequent transfer to a coin box, or to accommodate the coin in a rejection channel for return to the user.

Figure 3A:
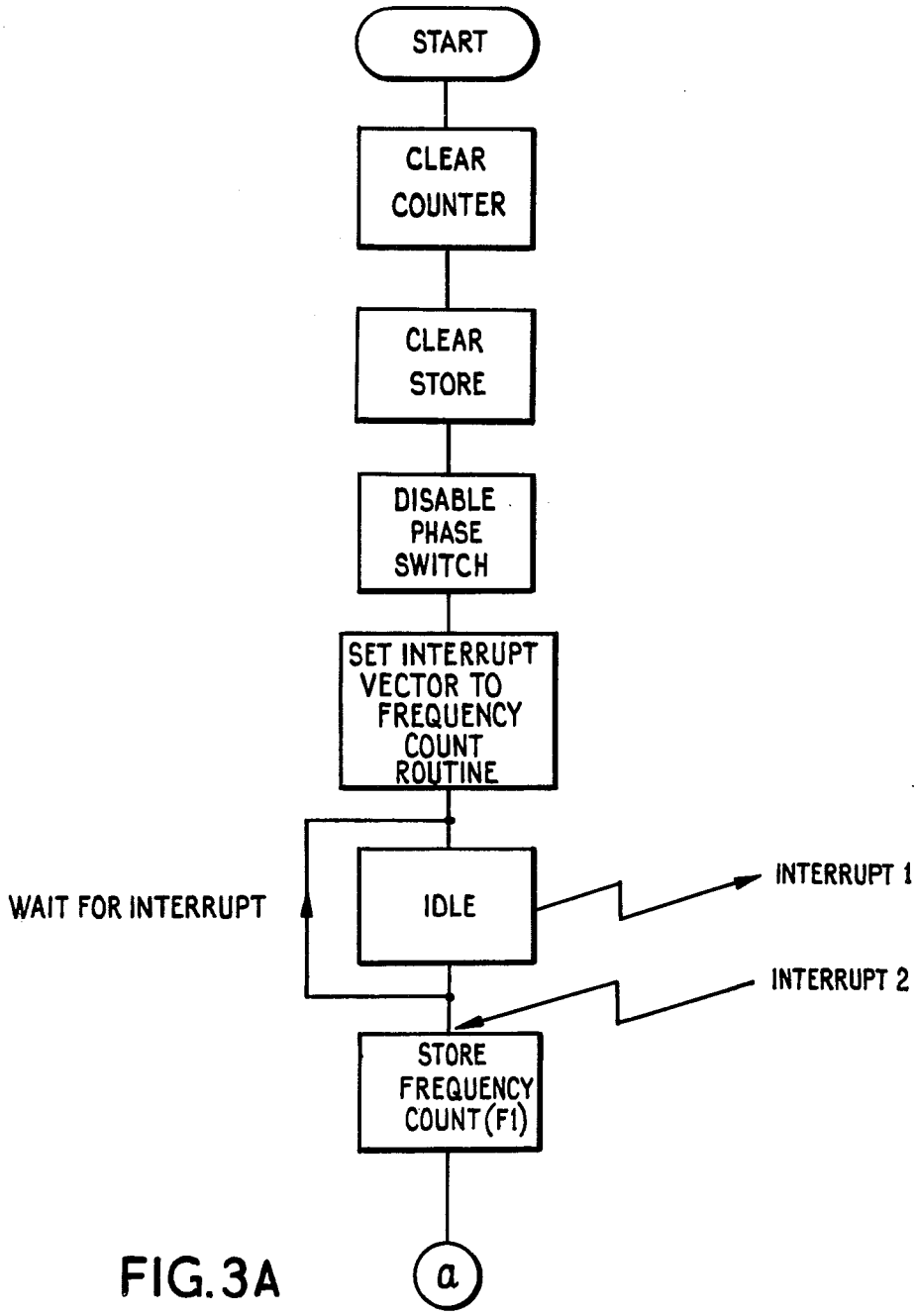
FIGS. 3A, 3B and 3C are flow charts of the main program used in the first example.
Figure 3B:
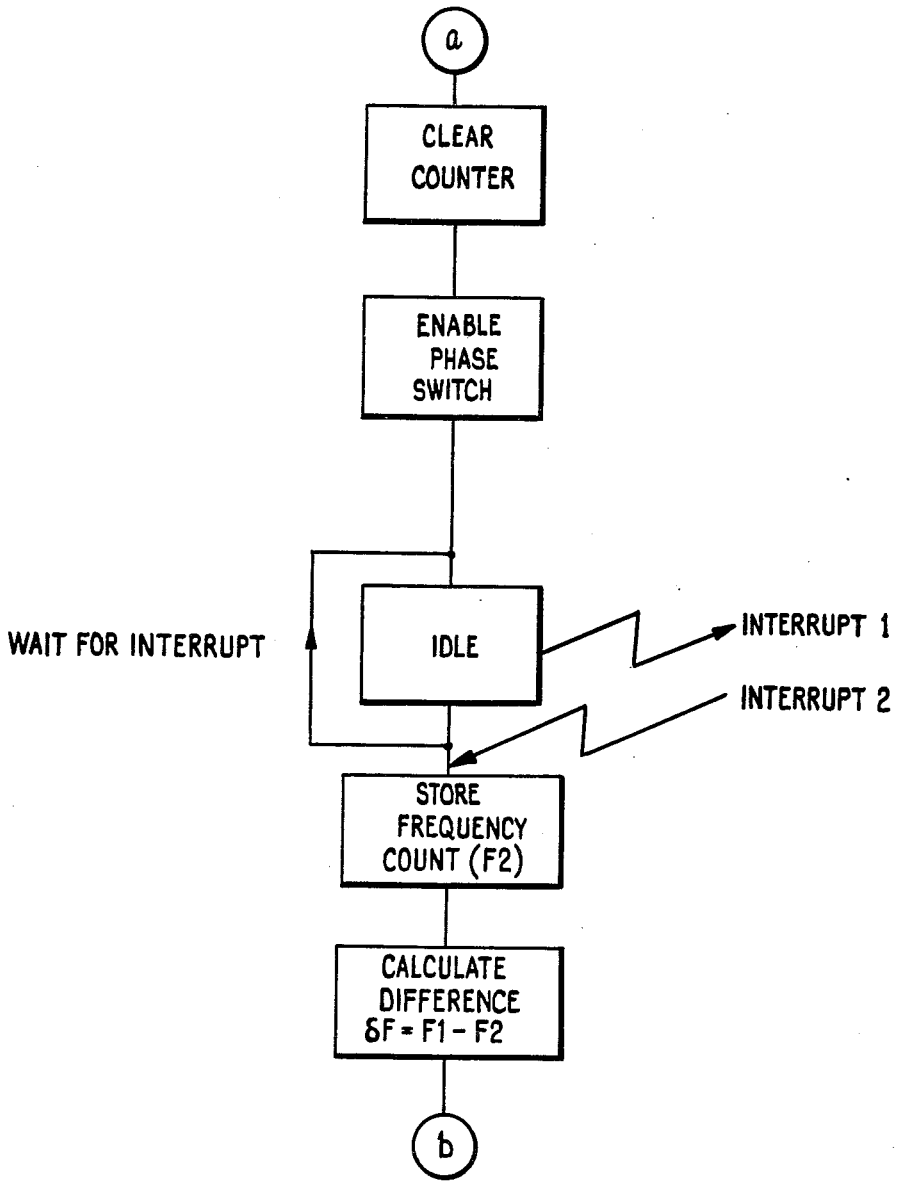
Figure 3C:
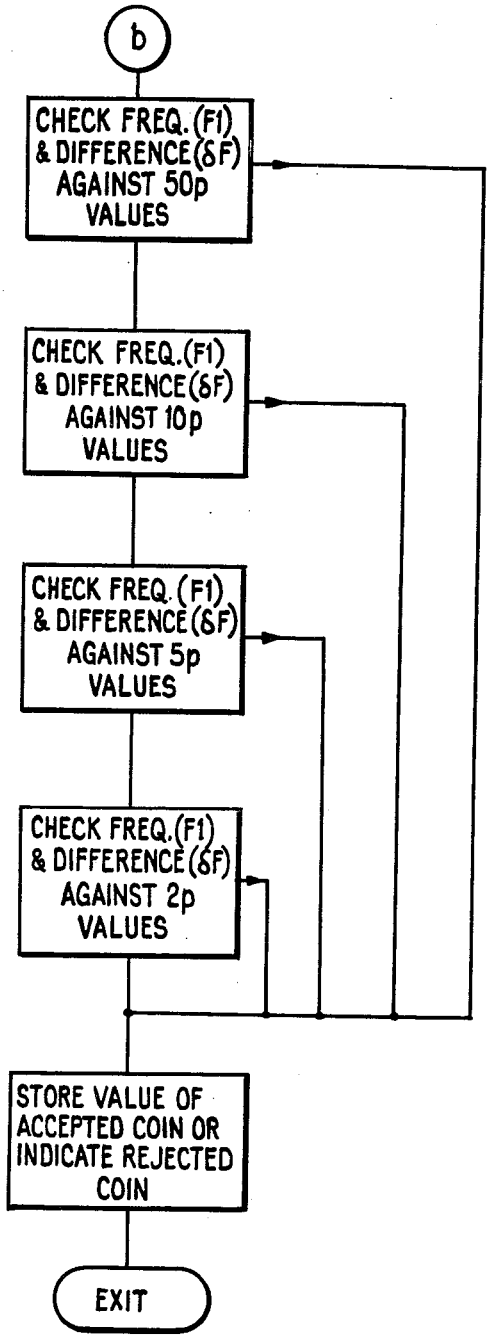
Figure 4A:
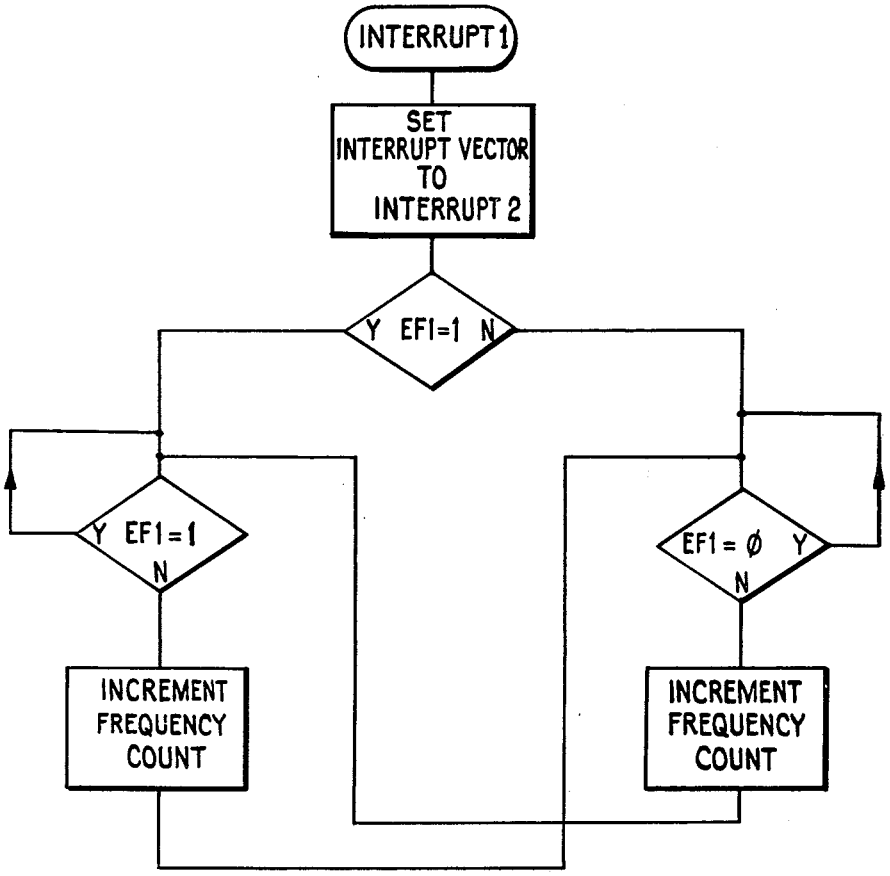
FIGS. 4A and 4B are flow charts of the sub-routine of the program used in the first example; and, FIG. 5 is a block diagram of the second example.
Figure 4B:
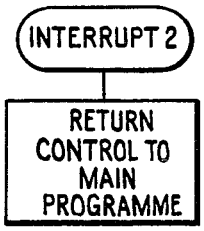

FIGS. 3A, B and C together illustrate the decision flow chart of the main program stored in the read only memory 12 and FIGS. 4A and B illustrate the two interrupt sub-routines that join the part of the main program illustrated in FIGS. 3A and 3B as interrupts 1 and 2. The apparatus that has been described operates on current British currency and checks for the presence of four different denominations of coin. The program can be modified readily to enable it to check for the presence of less or more than four different denominations of coin. Also, to enable the apparatus to operate with coins of different currency the reference values which are stored in the read only memory 13 and which define the acceptance values for valid coins are arranged to suit those of the coins of the particular currency to be validated.

Figure 5:
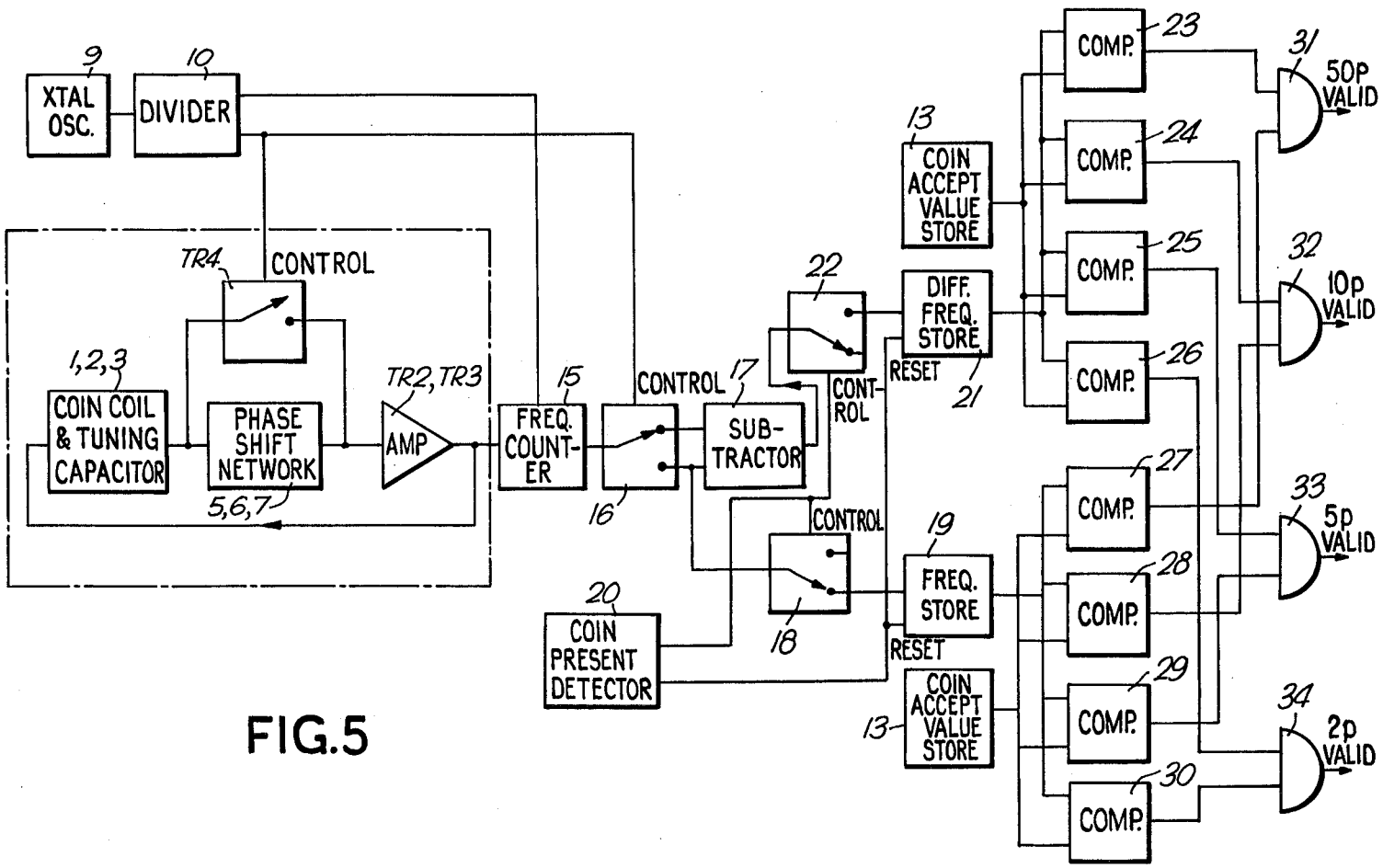

A second example of the apparatus is shown in FIG. 5. This example is a hard wired version of the coin validator circuit which basically performs the same functions as the circuit including the microprocessor described above. As far as possible the same reference numbers have been used in FIG. 5 as those used in the first example. In the second example, the power supply to the circuit is again connected upon lifting of the handset and closure of the "on hook" contacts of the telephone. The number of polarity reversals of the output of the oscillator in a unit time, for example 5 milliseconds, is computed by a counter 15 and fed through a control switch 16 into a subtractor 17 or through a further control switch 18 towards a frequency store 19. The control switch 16 is under the control of an output from the crystal oscillator 9 and divider 10 which also controls the operation of the switching transistor TR4 which switches the phase shift network into and out of the feedback loop. Thus when the phase shift network is switched out of the feedback loop the count from the counter 15 is fed into the frequency store 19. During the next unit time period when the phase shift network is switched into the feedback loop the count from in the frequency counter 15 is fed into the subtractor 17.

When a coin is present in the coin runway the coin present detector 20 sends a reset pulse to the frequency store 19 and a difference frequency store 21 and also operates control switches 18 and 22 so that they connect with the frequency store 19 and the difference frequency store 21 respectively. Thus, after a coin is present in the coin runway the count accumulated in the frequency counter 15 when the phase shift network is switched out of the feedback loop is fed to the frequency store 19 via control switches 16 and 18. During the following time period the count accumulated in the frequency counter 15 is fed to the subtractor 17 where it is subtracted from the count in the frequency store 19 and the difference between these two values is then fed into the difference frequency store 21.

Thus the difference value stored in the store 21 is the first parameter signal and thus corresponds to the change in frequency of the oscillation caused by introducing the phase shift network into the feedback loop when the coin is present; and the value stored in the store 19 is the second parameter signal which corresponds to the frequency of the oscillator when the phase shift network is switched out of the feedback loop and the coin is present.

The values stored in the stores 19 and 21 are compared with the reference values stored in the coin accept value store 13 (which for convenience is shown as two separate units) in comparators 23 to 30. The outputs of the comparators 23 and 27; 24 and 28; 25 and 29; and 26 and 30 are gated together by AND gates 31 to 34 respectively. If an output appears at the output of any one of the gates 31 to 34 this output indicates that the signals in the stores 19 and 21 both correspond to acceptable values for a coin of a particular denomination and indicate that the coin being examined is a valid coin of a particular denomination. This acceptance signal, or the failure of an acceptance signal within a preset time causes the coin to be released and taken into an acceptance channel for subsequent transfer to a coin receiving box, or rejection and return.

I claim:

1. A method of validating a coin comprising providing only a single feedback oscillator having a tuned electrical coil permanently connected in its feedback loop, positioning a coin adjacent said electrical coil, operating said single feedback oscillator and monitoring its frequency, selectively including a phase shifting network in said feedback loop of said single feedback oscillator, operating said single feedback oscillator and monitoring its frequency when said phase shifting network is included in its feedback loop, deriving from said monitored frequencies two parameter signals characteristic of the effect of said coin on the inductance and loss factor of said coil, and comparing said two parameter signals with reference values to determine if said coin is valid.

2. Coin validation apparatus comprising an electrical coil, means to hold a coin at a fixed reference position adjacent said electrical coil, only a single feedback oscillator including a feedback loop, said electrical coil being permanently connected in said feedback loop of said single feedback oscillator, a phase shifting network switchable into and out of said feedback loop, frequency monitoring means for monitoring the frequency of said single feedback oscillator and for outputting a signal indicative of its frequency, parameter means responsive to said output signal of said frequency monitoring means when said phase shifting network is both switched into and out of said feedback loop for producing two respective parameter signals characteristic of the effect of said coin on both the inductance and loss factor of said coil, and comparison means to compare said two parameter signals with reference values to determine if said coin is valid and to output a coin validation signal when both of said parameter signals correspond to said reference values.

3. The coin validation apparatus of claim 2, wherein said frequency monitoring means, said parameter means and said comparison means comprise a programmed microprocessor which is programmed to compare said output signal produced when said phase shifting network is switched into said feedback loop with said output signal produced when said phase shifting network is switched out of said feedback loop to produce a first of said parameter signals and to produce a second of said parameter signals dependent upon said output signal produced when said phase shifting network is switched out of said feedback loop.

4. The coin validation apparatus of claim 3, wherein said second parameter signal is said output signal produced when said phase shifting network is switched out of said feedback loop.

5. The coin validation apparatus of claim 3, wherein said second parameter signal is said output signal produced when said phase shifting network is switched out of said feedback loop operated on by a fixed operator.

6. The coin validation apparatus of claim 2, wherein said parameter means comprises first storage means for storing said output signal produced when said phase shifting network is switched out of said feedback loop, first comparison means for comparing said output signals produced when said phase shifting network is switched into said feedback loop with the signals stored in said first storage means to produce a first of said parameter signals, and second storage means for storing at least two reference values, said comparison means comprising a second comparison means to compare said first parameter signal and said content of said first storage means which forms a second of said parameter signals with said reference values stored in said second storage means to produce said coin validation signal when both of said coin parameter signals correspond to stored reference values.

7. The coin validation apparatus of claim 6, wherein said parameter means and said comparison means is implemented by a dedicated microprocessor.

8. The coin validation apparatus of claim 6, wherein said parameter means and said comparison means is implemented by a hard wired logic circuit.

9. A coin validation apparatus according to claim 2, wherein said phase shifting network produces a phase shift that varies with said frequency of oscillation of said oscillator.

10. The coin validation apparatus of claim 9, wherein said phase shifting network includes an operational amplifier, a parallel connected capacitive and resistive feedback network connected across said operational amplifier, and an input resistor connected between the inverting input of said operational amplifier and ground.

11. The coin validation apparatus of claim 10, wherein a solid state switch is also provided in parallel with said resistive capacitive feedback network of said operational amplifier to short out said parallel capacitive and resistive feedback network of said operational amplifier when said phase shifting network is to be switched out of said feedback loop of said feedback oscillator.

12. The coin validation apparatus of claim 2, wherein said coil is formed in two parts connected together in series with said means to hold said coin at a fixed reference position locating said coin in between said two parts of said coil.

13. The coin validation apparatus of claim 2, wherein said frequency monitoring means includes a counter arranged to count the number of oscillations of the feedback oscillator that occur within a preset time interval.

* * * * *